US005198099A

United States Patent [19]

Trachte et al.

[11] Patent Number: 5,198,099

[45] Date of Patent: Mar. 30, 1993

[54] THREE-STAGE PROCESS FOR PRODUCING ULTRA-CLEAN DISTILLATE PRODUCTS

[75] Inventors: Kenneth L. Trachte, Baton Rouge, La.; Willian Lasko, Flanders; Edward Effron, Springfield, both of N.J.; Gordon F. Stuntz, Baton Rouge, La.; Karl D. Chomyn, Denville, N.J.

[73] Assignee: Exxon Research and Engineering Company, Florham Park, N.J.

[21] Appl. No.: 743,958

[22] Filed: Aug. 12, 1991

[51] Int. Cl.[5] ..... C10G 69/00; C10G 69/02

[52] U.S. Cl. ..... 208/89; 208/88; 208/58; 208/210; 208/213

[58] Field of Search ..... 208/89

[56] References Cited

U.S. PATENT DOCUMENTS

| | | | |
|---|---|---|---|
| 3,239,447 | 3/1966 | Reeg et al. | 208/89 |
| 3,549,515 | 12/1970 | Brainard et al. | 208/89 |
| 3,600,299 | 8/1971 | Koller | 208/89 |
| 3,728,251 | 4/1973 | Kelley et al. | 208/89 |
| 4,554,065 | 11/1985 | Albinson et al. | 208/89 |
| 4,604,187 | 8/1986 | Ward | 208/89 |
| 4,613,425 | 9/1986 | Higashi et al. | 208/89 |
| 4,857,169 | 8/1989 | Abdo | 208/89 |

*Primary Examiner*—Helane E. Myers
*Attorney, Agent, or Firm*—Henry E. Naylor

[57] ABSTRACT

A process for producing ultra clean distillate and naphtha products wherein a distillate boiling range stream which contains heteroatoms and aromatics to subjected to three stage processing. The first stage is conventional hydrotreating, wherein the resulting effluent is further hydrotreated, but with a noble metal zeolite catalyst which is typically used for hydrocracking. The effluent from this second stage, which is now substantially free of heteroatoms, is passed to a third stage. This third stage is a hydrocracking stage, the severity of which will determine if the ultimate product will be a distillate or a naphtha.

7 Claims, 2 Drawing Sheets

THREE-STAGE PROCESS FOR PRODUCING ULTRA-CLEAN DISTILLATE PRODUCTS

FIELD OF THE INVENTION

The present invention relates to a three-stage process for producing naphtha and distillate products substantially free of heteroatoms and aromatics. The distillate products include diesel fuel, jet fuel, as well as specialty products.

BACKGROUND OF THE INVENTION

The production of clean distillate products is becoming more and more important in the refining process art. This is primarily because governmental regulations are placing even stricter limits on the amounts of heteroatoms, such as sulfur and nitrogen, as well as other pollutant precursors, which can be present in such products. Conventional processes for producing distillates generally require only two-stages. The first stage is usually a hydrotreating stage for removing heteroatoms followed by a second stage for converting more of the higher boiling feedstock to lower boiling products of higher value. While such a process may be satisfactory for most petroleum feedstocks, it is generally unsatisfactory for feedstocks, such as synthetic liquids, which contain relatively high amounts of heteroatoms and aromatics, notably polynuclear aromatics.

A typical two-stage process for producing distillates from such feedstocks is one wherein a coal liquid is first hydrotreated to remove heteroatoms such as sulfur and nitrogen. The second stage is a hydrocracking stage which is operated in extinction mode wherein everything boiling above the recycle cut point is ultimately cracked to products boiling below that point. The catalysts used for both stages can be conventional hydrotreating and hydrocracking catalysts. While a process such as this has met with some degree of success, it is faced with long-term activity maintenance problems and ability to maintain low levels of aromatics in the product.

SUMMARY OF THE INVENTION

In accordance with the present invention, there is provided a process for producing ultra clean naphtha and distillate products, boiling within the range of about 35° C. to 400° C. and containing substantially no heteroatomics, which process comprises:

(a) hydrotreating the feedstock in a first stage at conditions which include the presence of hydrogen; temperatures within the range of 200° C. to 400° C., and a catalyst comprised of at least one Group VIII metal, and a Group VI metal on an inorganic oxide support;

(b) further hydrotreating the effluent from the first stage in a second stage at a temperature ranging from about 190° C. to 360° C., in the presence of hydrogen, and a noble metal containing zeolite catalyst; in such a way that cracking is minimized, and (c) hydrocracking the effluent from the second stage at a temperature from about 200° C. to 370° C., in the presence of hydrogen and a noble metal containing zeolite catalyst, with the proviso that the temperature of this third stage is at least 15° C. higher than that of the second stage.

In a preferred embodiment of the present invention, the heat release from the second stage is kept separate from heat release from the third stage to provide greater process control.

In other preferred embodiments of the present invention, the catalyst of the first hydrotreating stage is a Ni/Mo on alumina catalyst and the catalyst for the remaining two stages is a Pd on zeolite catalyst.

In another preferred embodiment of the present invention the feedstock is a coal liquid.

In yet another embodiment of the present invention, both the second and third stages are performed in the same reactor.

DETAILED DESCRIPTION OF THE INVENTION

While this process is applicable to petroleum distillate feedstocks, feedstocks which are particularly suitable for the present invention are those feedstocks boiling in the range which can be used to produce naphthas and distillates and which can normally not be processed by conventional techniques to yield ultra-clean distillate products. Such feedstocks are typically synthetic liquid derived from such carbonaceous materials as coal and oil-shales. These feedstocks typically contain relatively large amounts of heteroatoms and aromatics when compared to more conventional petroleum feedstocks. For example, liquids resulting from the liquefaction of coal generally contain up to about 2 wt. % sulfur, 1.5 wt. % nitrogen, 4 wt. % oxygen, and 90 wt. % aromatics. By use of the process of the present invention, naphtha and distillate products can be produced which are substantially free of heteroatoms and aromatics. By substantially free of heteroatoms, we mean that the final product will contain less than about 0.1 wt. % heteroatoms, preferably less than about 100 wppm heteroatoms, and more preferably less than about 10 wppm heteroatoms. The resulting cracked naphtha and distillate products will also contain less than about 10 wt. % aromatics, preferably less than about 5 wt. %, and more preferably less than about 1 wt. %. Naphthta taken from the first stage (hydrotreated but not cracked) may contain higher levels of aromatics. The process of the present invention is particularly suited for producing sulfur-free diesel and jet fuels. Another benefit of the present invention is that the resulting fuel products have extraordinary shelf-life, that is, they are ultra stable.

Figure 1:
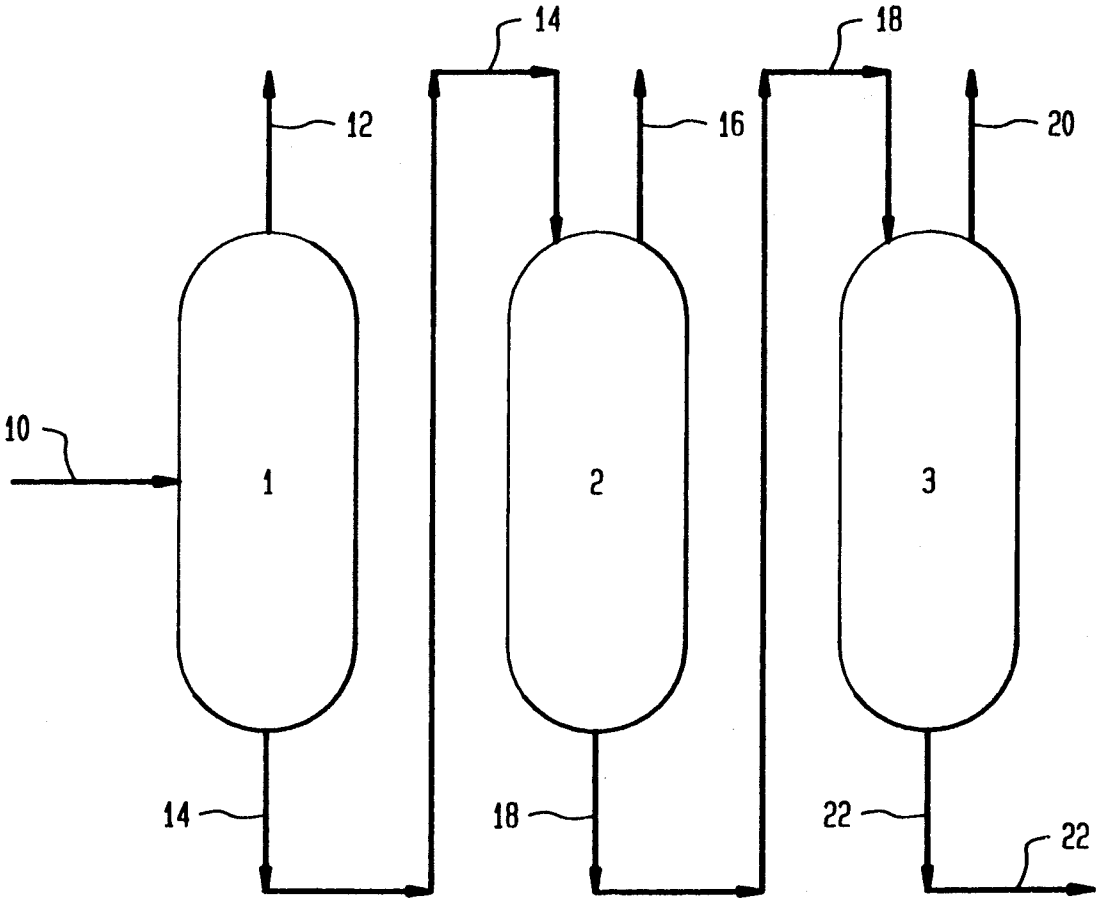
FIG. 1 hereof is a preferred embodiment of a simplified flow scheme of the three-stage process of the present invention.

Turning now to FIG. 1 hereof, the feedstock, preferably a coal liquid, is fed via line 10 to a first stage 1, which is conventional hydrotreating. The hydrotreating is conducted at standard hydrotreating conditions which comprises a temperature from about 200° C. to 400° C., preferably about 360° C. to 400° C.; a pressure from about 250 to 2500 psig, preferably from about 1500 to 2000 psig; an hourly space velocity from about 0.2 to 6 V/V/Hr, preferably 0.3 to 0.5 V/V/Hr; whereon V/V/Hr means the volume of oil per hour per volume of catalyst, and a hydrogen gas rate of 500 to 8000 standard cubic feet per barrel (SCF/B), preferably 4000 to 6000 SCF/B.

The catalyst employed in the first stage may be any conventional hydrotreating catalyst suitable for desulfurizing and denitrogenizing the distillate feedstream. Typically, such catalysts are comprised of at least one Group VIII metal and a Group VI metal on an inorganic refractory support, which is preferably alumina or alumina-silica. Said Groups are from the Periodic table of the Elements, such as that found on the last page of Advanced Inorganic Chemistry, 2nd Edition 1966, Interscience Publishers, by Cotton and Wilkenson. The Group VIII metal is present in an amount ranging from about 2 to 20 wt. %, preferably from about 4 to 12 wt. %. Preferred Group VIII metals include Co, Ni, and Fe, with Co and Ni being most preferred. The preferred Group VI metal is Mo which is present in an amount ranging from about 5 to 50 wt. %, preferably from about 10 to 40 wt. %, and more preferably form about 20 to 30 wt. %. All metals weight percents are on support. By "on support" we mean that the percents are based on the weight of the support. For example, if the support were to weight 100 g., then 20 wt. % Group VIII metal would mean that 20 g. of Group VIII metal was on the support.

Any suitable inorganic oxide support material may be used for the catalysts of the present invention. Preferred are alumina and silica-alumina. More preferred is alumina. The silica content of the silica-alumina support can be from about 2 to 30 wt. %, preferably 3 to 20%, more preferably 5 to 19 wt. %. Other refractory inorganic compounds may also be used, non-limiting examples of which include zirconia, titania, magnesia, and the like. The alumina can be any of the aluminas conventionally used for hydrotreating catalysts. Such aluminas are generally porous amorphous alumina having an average pore size from about 50 to 200 Å, preferably from about 70 to 150 Å, and a surface area from about 50 to about 450 $m^2/g$, preferably from about 100 to 300 $m^2/g$.

In this first stage hydrotreating zone, up to about 90 wt. % or more of the heteroatoms are removed with little cracking. Light products (350° F.−) such as chemical gases, light hydrocarbon gases, naphtha and water are taken overhead via line 12 where the components are separated via conventional techniques such as distillation and flashing. Chemical gases include such gases as as $CO_2$, CO, $NH_3$, and $H_2$. The 350° F.+ fraction from the first stage is passed via line 12 to a second stage 2, which is also a hydrotreating stage. While the effluent may contain acceptably low levels of sulfur, it nevertheless typically contains unacceptably high levels of nitrogen. It is preferred that the nitrogen level be less than 100 ppm, preferably less than about 50 ppm, more preferably less than about 25 ppm, and most preferably less than 10 ppm. Even relatively low levels of nitrogen, particularly organic nitrogen, will act as a catalyst poison in the third stage 3, which is a hydrocracking stage. The second stage hydrotreating is conducted at relatively mild conditions so as to remove the remaining heteroatoms, particularly nitrogen, and hydrogenate aromatic compounds, while keeping cracking at a minimum. This is accomplished through heat release dissipation for hydrogenation only. Hydrocracking heat release is taken in the third stage. Conditions of this second stage hydrotreating include temperatures from about 190° C. to 360° C., preferably from about 200° C. to 315° C., and more preferably from about 230° C. to 260° C., pressures from about 800 psig to 2000 psig, preferably about 1300 psig to 1700 psig; hourly space velocities from about 0.5 to 4 V/V/Hr, preferably about 1.5 to 2.5 V/V/Hr; and a hydrogen gas rate of about 5000 to 10,000 SCF/B, preferably about 7000 to 8000 SCF/B. Cracking is also minimized by adjusting the temperature of this second stage in accordance with the activity of the catalyst. That is, more active catalysts are run at lower temperatures than less active catalysts.

Any remaining light hydrocarbon gases are taken overhead via line 16. The remaining effluent from the second stage 2, which is now substantially free of heteroatoms, and low in aromatics, is passed via line 18 to the third stage 3. The operating conditions for this third stage, which is a hydrocracking stage, are similar to those for the second stage except that the temperature will range from about 200° C. to 370° C., preferably from about 220° C. to 330° C., more preferably from about 245° C. to 315° C., and the hourly space velocity will range from about 0.5 to 3 V/V/Hr, preferably about 1 to 2 V/V/Hr. Because it is desired that most of the hydrocracking take place in third stage, it is operated at a temperature at least 15° C., preferably at least 30° C. greater, than the second stage. It is to be understood that the second and third stages can be in separate reactors or different stages in one reactor.

Light hydrocarbon gases left in the system can be collected overhead via line 20 and the final distillate or naphtha product stream is collected via line 22. This product stream is substantially free of heteroatoms and aromatics.

Having thus described the present invention, and preferred embodiments thereof, it is believed that the same will become even more apparant by the examples to follow. It will be appreciated, however, that the examples are for illustrative purposes and are not intended to limit the invention.

EXAMPLES

The catalysts suitable for use in the second and third stages are conventional hydrocracking catalysts. Hydrocracking catalysts in general are described in detail in U.S. Pat. No. 4,921,595 to UOP, which is incorporated herein by reference. Such catalyst are typically comprised of a Group VIII metal hydrogenating component on a zeolite cracking base. The zeolite cracking bases are sometimes referred to in the art as molecular sieves, and are generally composed of silica, alumina and one or more exchangeable cations such as sodium, magnesium, calcium, rare earth metals, etc. They are further characterized by crystal pores of relating uniform diameter between about 4 and 14 Angstroms. It is preferred to employ zeolites having a relatively high silica/alumina mole ratio between about 3 and 12, more preferably between about 4 and 8. Suitable zeolites found in nature include mordenite, stalbite, heulandite, ferrierite, dachiardite, chabazite, erionite, and faujasite. Suitable synthetic zeolites include the B, X, Y, and L crystal types, e.g., synthetic faujasite and mordenite. The preferred zeolites are those having crystal pore diameters between about 8 to 12 Angstroms, with a silica/alumina mole ratio of about 4 to 6. A particularly preferred zeolite is synthetic Y.

While such Group VIII metals as iron, cobalt, nickel, ruthenium, rhodium, palladium, osmium, iridium, and platinum can be used on the catalyst of the second and third stages, the noble metals are preferred. More preferred are platinum and palladium.

The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, palette with added lubricants, binders or the oil if desired, and calcined in air at temperatures of, e.g., 700°-1200° F. (370° C-650° C.) in order to activate the catalyst and decompose ammonium ions. Alternatively, the zeolite component may first be palette, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

Upgrading experiments were performed in a small, fixed catalyst bed, continuous feed unit. The distillate feed and hydrogen feed rates were from 100-300 gms/hr and 5-10 SCF/H, respectively. The experiments lasted from 3 to 6 months, such that catalyst activity maintenance could be evaluated as well as hydrogenating and cracking kinetics. The first stage hydrotreater product was not fractionated to remove the 175° C.− product, as could be done in a commercial case. Rather the entire TLP (total liquid product) was fed to the second and third stages for convenience sake.

Figure 2:
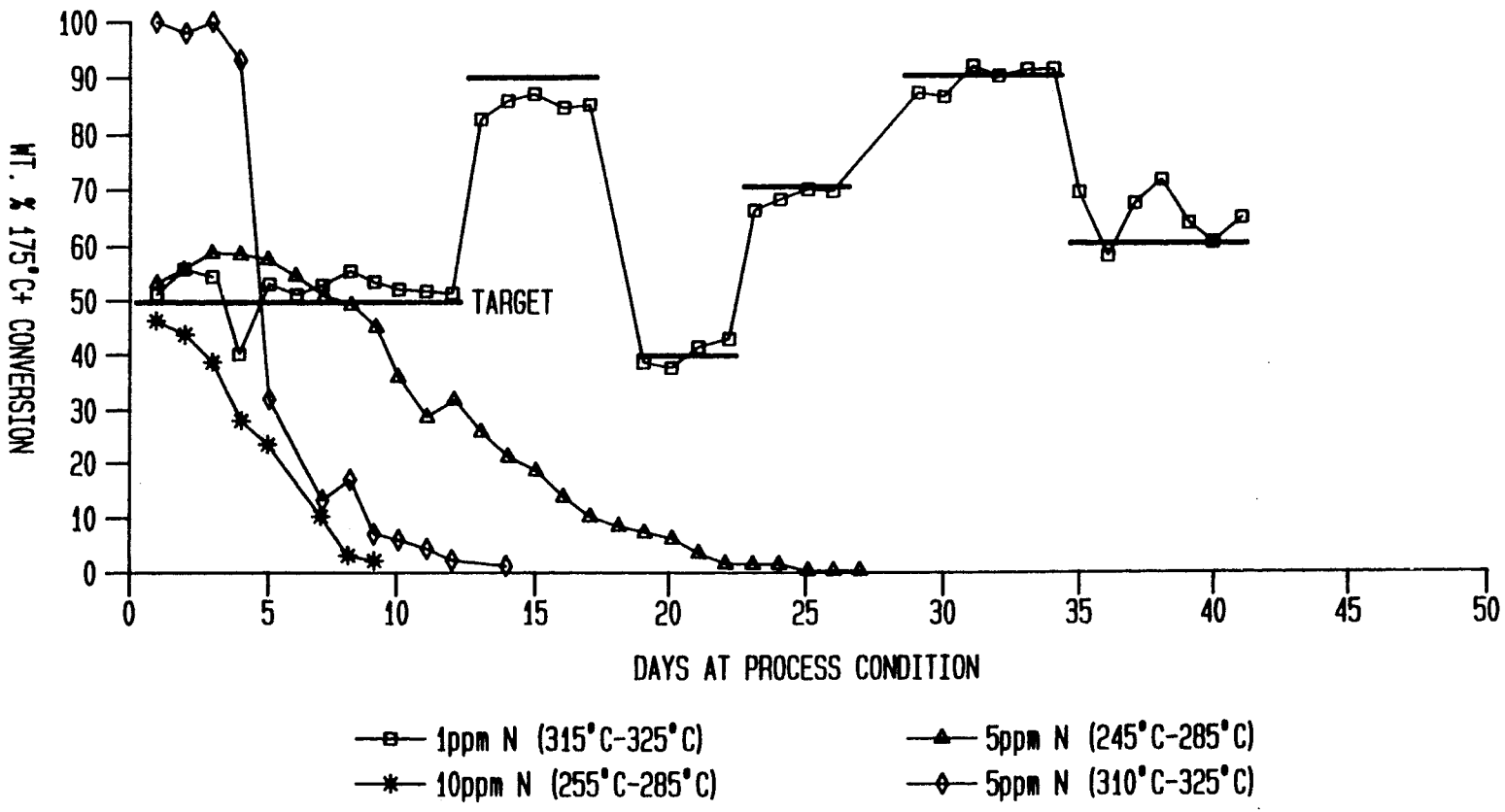
FIG. 2 hereof is a plot of the effect of nitrogen level on conversion activity of the 175° C.+ fraction of a coal liquid over time (in days).

With this invention, the first stage primarily removes heteroatoms and does partial hydrogenation of aromatics. The second stage essentially removes the remaining heteroatoms and saturates the remaining aromatics to provide a sweet feed to the third stage, where sweet hydrocracking is performed. Nitrogen removal is critical to long term activity maintenance and process control in the third stage. Third stage catalyst activity appears directly related to nitrogen level, as can be seen in FIG. 2. This figure shows the wt. % conversion of 175° C.+ distillate to 175° C.− product in third stage hydrocracking. An initial target of 50 wt. % conversion was met for only the first day with 10 ppm N feed to the third stage. Conversion dropped rapidly to essentially zero after only 9 days even though third stage temperature was increased from 225° C. to 285° C. during this time in an attempt to meet the target conversion.

The same experiment with 5 ppm N feed maintained near target conversions for about 8 days before a similar rapid decline to zero conversion after 22 days. Starting the experiment at a higher temperature (310° C.) gave very high conversion initially (near 100%), but resulted in an even more precipitous drop to zero conversion after only 14 days. Increasing temperature to 325° C. near the end of the run only slightly prolonged the conversion decline.

However, when feed N was reduced to the 1 ppm level, conversion maintenance was achieved for at least 40 days at several different levels, after which the run was voluntarily ended. As seen in the figure, the initial 50% conversion target was met for 12 days after which the third stage temperature was adjusted between 310° C. and 325° C. to meet the other target conversions. This three stage combination also permits more precise control over the process heat release and thus the product composition, i.e. with ultra-clean hydrocracking frequent temperature cycling/increase is not required to remove/react nitrogen compounds adsorbing on the third stage catalyst. In each case, the target conversion was maintained at constant temperature. The key, then, to this process is to keep the third stage feed ultra clean by proper adjustment of the first and second stage process conditions.

A three stage process was run in accordance with the present invention and the conditions and results are set forth in Table I below. In a preferred embodiment of this invention (Table I), the first stage is operated at 365° C./0.35 LHSV/2000 psig $H_2$/ 8000 SCF/B $H_2$ TGR using KF-840 Ni/Mo catalyst. KF-840 is an alumina supported catalyst and is reported to contain about 12.7 wt. % Mo, and 2.5 wt. % Ni, and 6.4 wt. % $P_2O_5$, and a surface area of about 135 $m^2/g$ and a pore volume of about 0.38 cc/g. Nitrogen and sulfur are reduced by over 99% to 8 and 21 ppm, respectively. Aromatics are reduced from 82% to 40%. While the $C_5$/175° C. reformate produced from reforming the naphtha stream (110 RONC) from this stage is excellent (and would be removed as product in a commercial plant), the 175° C./345° C. distillate only marginally meets current diesel stability and cetane specifications.

Near complete saturation in the second stage operating at 275° C./2.5 LHSV/1500 psig $H_2$/8000 SCF/B $H_2$ TGR significantly reduces the sediment formed in 100 days from 1.1 to 0.11 mg/100 ml and improves cetane number to 43. Thus the second stage saturation produces an exceptionally stable and high quality diesel and/or jet fuel. The highly cyclic nature of this product also implies use as specialty chemical products.

Hydrocracking in the third stage at 315° C./1.9 LHSV/1500 psig $H_2$/8000 scf/bbl $H_2$ TGR results in essentially 100% saturation of aromatics. Any desired conversion between all diesel product and about a 90%/10% naphtha/diesel product split can be achieved with the same ultra clean product qualities. $C_5$/175° C. reformate produced from the third stage naphtha is also high octane and engine tested at 106 RONC.

TABLE I

| | Preferred Embodiment | | | |
|---|---|---|---|---|
| Conditions | Raw Coal Distillate | Stage 1 Effluent | Stage 2 Effluent | Stage 3 Product |
| Temperature, °C. | | 365 | 275 | 315 |
| LHSV, 1/hr | | 0.35 | 2.5 | 1.9 |
| $H_2$ Pressure, psig | | 2000 | 1500 | 1500 |
| $H_2$ TGR, scf/bbl | | 6000 | 8000 | 8000 |
| Catalyst | | KF-840 Ni/Mo | HC-18 Pd on USY | HC-18 Pd on USY |
| Inspections | | | | |
| Gravity, API @ 15° C. | 11.2 | 29 | 33 | 42-54 |
| Wt. % Carbon | 85.4 | 87.4 | 86.4 | 85.2 |
| Wt. % Hydrogen | 9.0 | 12.4 | 13.5 | 14.3 |
| H/C Atomic Ratio | 1.27 | 1.69 | 1.86 | 2.00 |
| ppm Nitrogen | 9900 | 8 | 1 | 0.8 |
| ppm Sulfur | 2700 | 21 | 0.7 | 0.3 |

TABLE I-continued

| Conditions | Preferred Embodiment Raw Coal Distillate | Stage 1 Effluent | Stage 2 Effluent | Stage 3 Product |
|---|---|---|---|---|
| ppm Oxygen | 42500 | 1500 | n/a | <100 |
| Wt. % Aromatics | 82.0 | 40.0 | 6.0 | 0.2 |
| Wt. % 175° C.⁻ | 0.9 | 19.0 | 20.0 | 50-93 |
| Wt. % 345° C.+ | 4.8 | 2.5 | 1.7 | 0.0 |
| Products | | | | |
| $C_5$/175° C. Reformate | | | | |
| RONC | | 110 | n/a | 106 |
| LV % $C_5$ + Yield | | 85.9 | n/a | 81.8 |
| 175/345° C. Diesel | Spec | | | |
| Cetane # | 40 | 39 | 43 | 41 |
| 100 Day Stability | | | | |
| mg/100 ml @ 43° C. | 1.0 | 1.0 | 0.11 | 0.16 |
| High Density Jet | | | | |
| % Aromatics | <5 | 40 | 6.0 | 0.2 |
| ppm Sulfur | <50 | 21 | 0.7 | 0.3 |
| API Gravity | 26-37 | 29 | 33 | 42-54 |
| Performance | | | | |
| % Arom Sat'n | | 51.2 | 92.7 | 99.8 |
| % HDN | | 99.9 | >99.9 | >99.99 |
| % HDS | | 99.2 | >99.9 | >99.99 |
| % HDO | | 96.5 | n/a | >99.8 |

What is claimed is:

1. A process for producing naphtha and distillate products which are substantially free of heteroatoms and aromatics, from heteroatom and aromatic containing distillate feedstocks, which process comprises:

(a) hydrotreating the feedstock in a first stage at conditions which include the presence of hydrogen, temperatures within the range of about 200° C. to 400° C.; and a catalyst comprised of at least one Group VIII metal, and a Group VI metal, on an inorganic oxide support;

(b) further hydrotreating the effluent from the first stage, in a second stage, at a temperature ranging from about 195° C. to 360° C., in the presence of hydrogen and a noble metal containing zeolite catalyst; such that substantially no cracking occurs; and (c) hydrocracking the effluent from the second stage in a third stage at a temperature from about 200° C. to 370° C., in the presence of hydrogen and a noble metal containing zeolite catalyst, with the proviso that the temperature of this third stage be at least 15° F. higher than that of the second stage and that it be high enough to cause cracking, wherein no products from this thrid stage are recycled.

2. The process of claim 1 wherein heat release from the second stage is kept separate from heat release from the third stage.

3. The process claim 2 wherein the catalyst used in the first stage is comprised of: (i) about 2 to 20 wt. % of a metal selected from Co and Ni; (ii) about 5 to 50 wt. % of Mo; and (iii) an alumina support on alumina-silica.

4. The process of claim 3 wherein the catalysts of the second and third stages is comprised of a metal from Group VIII of the Periodic Table of the Elements on a zeolitic material having a silica to alumina ratio of about 3 to 12, and an average pore diameter of about 4 to 14 Angstroms.

5. The process of claim 4 wherein the zeolitic material is selected from the group consisting of mordenite, stalbite, heulandite, ferrierite, dachiardite, chabazite, erionite, and a faujasite.

6. The process of claim 5 wherein the zeolitic material is a zeolite Y.

7. The process of claim 6 wherein the catalyst of stage 1 is comprised of 4 to 12 wt. % of Co or Ni and 20 to 30 wt. % Mo, on an alumina or alumina-silica support.

* * * * *